US006621403B2

(12) United States Patent
Nagahiro et al.

(10) Patent No.: US 6,621,403 B2
(45) Date of Patent: Sep. 16, 2003

(54) OVERLOAD TRIPPING DEVICE FOR CIRCUIT BREAKER

(75) Inventors: Isamu Nagahiro, Saitama (JP); Naoshi Uchida, Saitama (JP); Katsunori Kuboyama, Saitama (JP); Jun Oyama, Tokyo (JP)

(73) Assignee: Fuji Electric Co., Ltd., Kawasaki (JP)

( * ) Notice: Subject to any disclaimer, the term of this patent is extended or adjusted under 35 U.S.C. 154(b) by 45 days.

(21) Appl. No.: 09/988,810

(22) Filed: Nov. 20, 2001

(65) Prior Publication Data

US 2002/0063619 A1 May 30, 2002

(30) Foreign Application Priority Data

Nov. 30, 2000 (JP) ..... 2000-364331

(51) Int. Cl.[7] ..... H01H 71/10; H01H 71/16; H01H 61/01

(52) U.S. Cl. ..... 337/75; 337/101; 337/111; 337/39; 335/145; 335/141; 335/31; 335/44

(58) Field of Search ..... 337/36–40, 55, 337/56, 59, 75, 78, 99, 101, 111; 335/21, 27, 31, 43, 44, 141, 145

(56) References Cited

U.S. PATENT DOCUMENTS 4,635,020 A * 1/1987 Sako ..... 337/49
4,652,847 A * 3/1987 Sako ..... 337/49
4,808,961 A * 2/1989 Sako et al. ..... 337/49
4,845,455 A * 7/1989 Sako et al. ..... 337/49
4,884,049 A * 11/1989 Oyama et al. ..... 337/36
5,245,302 A * 9/1993 Brune et al. ..... 335/35
5,767,762 A * 6/1998 Sako ..... 337/348

FOREIGN PATENT DOCUMENTS

JP 2000348597 A * 12/2000 ..... H01H/73/22
JP 2001256876 A * 9/2001 ..... H01H/73/22
JP 2001345038 A * 12/2001 ..... H01H/83/14
JP 2002170474 A * 6/2002 ..... H01H/73/02

* cited by examiner

*Primary Examiner*—Anatoly Vortman
(74) *Attorney, Agent, or Firm*—Kanesaka & Takeuchi

(57) ABSTRACT

An overload tripping device includes a temperature-compensating bimetal operating as a tripping lever and interposed between an output lever of a differential shifter mechanism linked with a main bimetal and a latch receiver of an opening-and-closing mechanism section of a circuit breaker. The temperature-compensating bimetal has an intermediate portion journaled on a bimetal holder. An operating arm made of a light molding material is attached to a tip of the temperature-compensating bimetal so as to push the latch receiver. Additionally, a balance weight may be installed on the temperature-compensating bimetal to balance inertial moments on the opposite sides of the bimetal. Thus, the circuit breaker is prevented from being inadvertently tripped due to external stimulus.

4 Claims, 3 Drawing Sheets

Fig. 1(a)
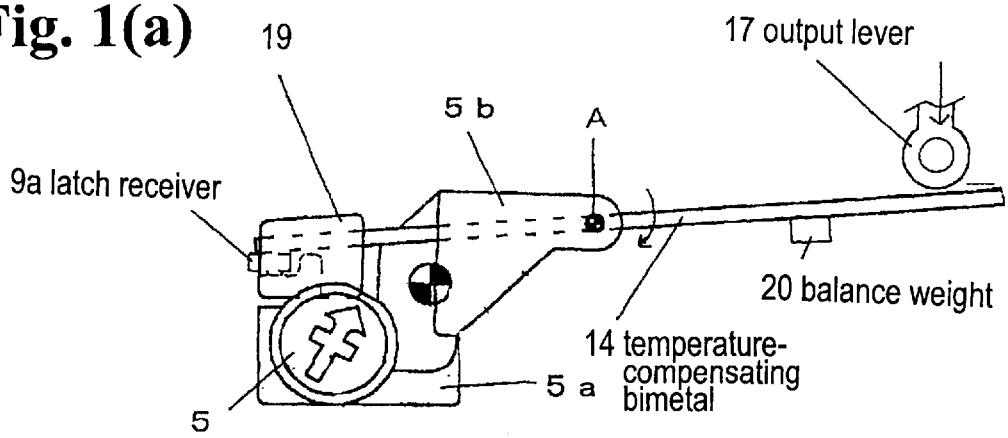
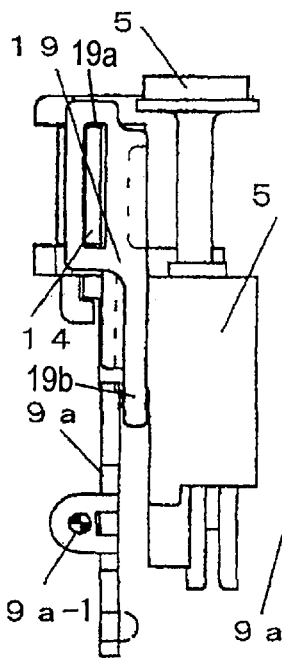
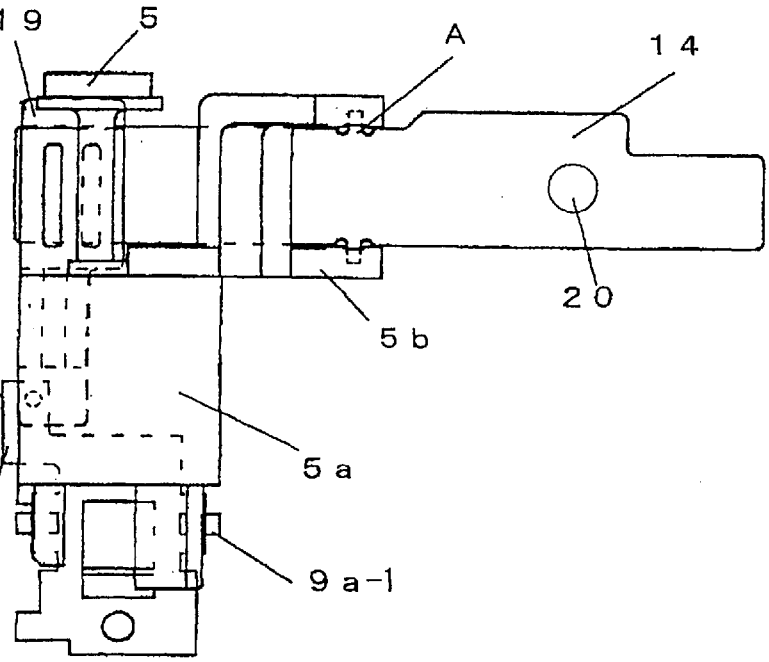
Fig. 1(b) Fig. 1(c)

Fig. 2(a)
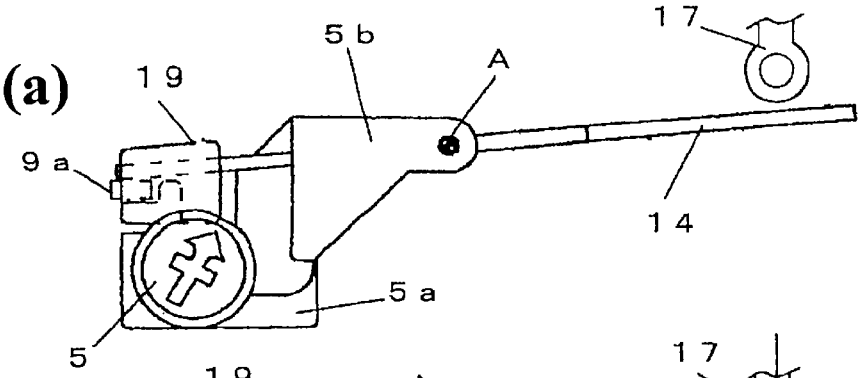
Fig. 2(b)
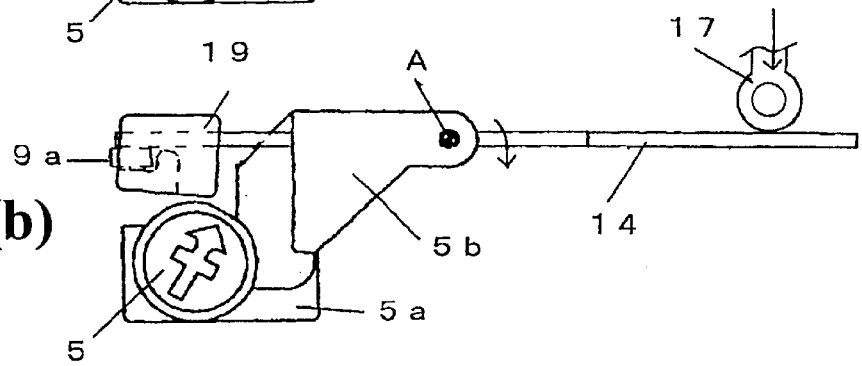
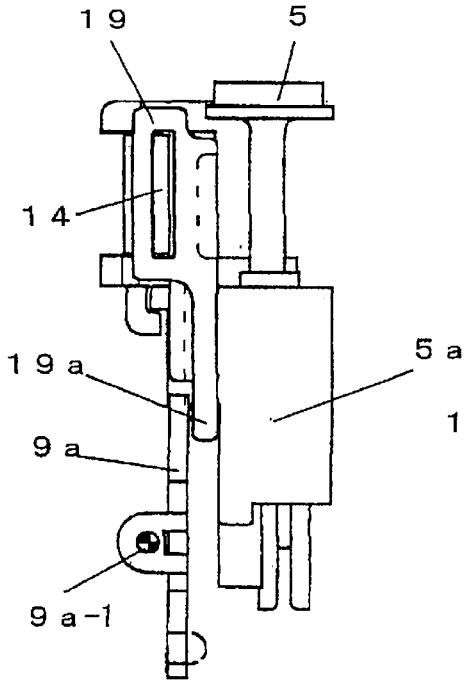
Fig. 2(c)
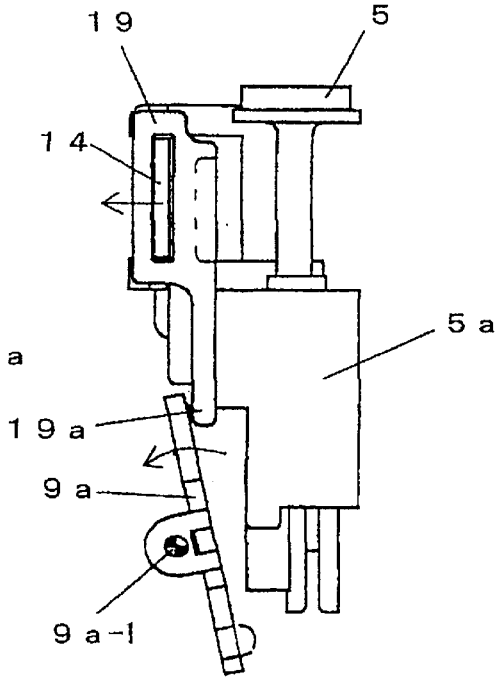
Fig. 2(d)

OVERLOAD TRIPPING DEVICE FOR CIRCUIT BREAKER

BACKGROUND OF THE INVENTION AND RELATED ART STATEMENT

The present invention relates to a bimetal overload tripping device installed in a circuit breaker, such as an autobreaker.

Taking the autobreaker as an example, a configuration of a circuit breaker in which the present invention is implemented will be described with reference to FIGS. 3(*a*) and 3(*b*). In these figures, reference numeral 1 denotes a main body case of a circuit breaker (in the figures, the cover has been removed from the case), 2 is a power supply side main circuit terminal, 3 is a load side circuit terminal, 4 is a handle for opening and closing operations, and 5 is an adjustment dial for adjusting a current flowing through a thermal overload/open-phase tripping device to a rated value described below. The case 1 internally has a breaking section 8 formed of a movable contact shoe 8*a*, a fixed contact shoe 8*b*, and an arc extinguish chamber 8*c*, an opening-and-closing mechanism section 9 for driving the movable contact shoe 8*a* of the breaking section 8 to an open or a closed position, a thermal overload/open-phase tripping device 10, an electromagnetic instantaneous tripping device 11, and other parts.

The thermal overload/open-phase tripping device 10 is formed of a combination of a heater-mounted main bimetal 12 connected to each phase of a main circuit, a differential shifter mechanism 13 linked with an operating end of the main bimetal of each phase to detect operational displacement of the bimetal, and a temperature-compensating bimetal 14 interposed between the differential shifter mechanism 13 and a latch receiver incorporated in the opening-and-closing mechanism section 9 to transmit an output signal from the differential shifter mechanism to the latch receiver in order to trip the opening-and-closing mechanism section 9, with the temperature-compensating bimetal also acting as a tripping lever.

Furthermore, the differential shifter mechanism 13 includes a combination of a slide push shifter 15 and a pull shifter 16 located on opposite sides of the arrangement of the main bimetal 12 of each phase, and fitted and supported in a groove in an interphase partition wall 1*b* of the case 1, with an output lever 17 extending across the top surfaces of the push shifter 15 and pull shifter 16 and coupled to these shifters 15 and 16 with pins so as to move therewith. Arm portions projecting from the push shifter 15 and pull shifter 16 face each other, with the main bimetal 12 of each phase located between the arm portions.

The temperature-compensating bimetal 14 in the illustrated example is formed by bending a piece of bimetal like a hair pin, and has one end journaled on a bearing 18 linked with the adjustment dial 5 and the other end facing the output lever 17 of the above-described differential shifter mechanism 13. Moreover, an operating piece extending from near the bearing toward the opening-and-closing mechanism section 9 faces the latch receiver of the opening-and-closing mechanism section.

When the overload tripping device configured as described above is operated, an overload current flows through the main circuit to bend the main bimetal 12 in a predetermined direction, and the push shifter 15 and pull shifter 16 of the differential shifter mechanism 13 are displaced so as to follow the bending of the main bimetal 12.

Then, the output lever 17 pushes a tip of the temperature-compensating bimetal 14. Therefore, the temperature5 compensating bimetal 14 rotates clockwise around a shaft support point of the bearing 18, causing the operating piece thereof to push the latch receiver to a released position. Synchronously with this movement, the opening-and-closing mechanism section 9 is tripped to open the movable contact shoe 8*a* of the breaking section 8, thereby interrupting the main circuit current. Furthermore, if an open phase occurs in the main circuit, the push shifter 15 and pull shifter 16 of the differential shifter mechanism 13 differentially operate to cause the output lever 17 to rotate counterclockwise around the pin coupling the output lever to the pull shifter. Thus, the temperature-compensating bimetal 14 is pushed to trip the circuit breaker, as described above.

Since the driving force or displacement of the main bimetal, which is effected when the main bimetal is bent to swing the temperature-compensating bimetal 14, is small, the latch receiver of the opening-and-closing mechanism section 9 is designed to move to its release position under a weak driving force.

In contrast, the electromagnetic instantaneous tripping device 11 includes a tripping coil 11*a* connected to the main circuit, a yoke 11*b*, a plunger 11*c*, and a tripping lever 11*d* following a movement of the plunger 11*c*. When an overcurrent flows through the main circuit due to a short circuit or the like, the plunger 11*c* carries out a sucking or pulling operation, causing the tripping lever lid to release the latch receiver of the opening-and-closing mechanism section 9, thereby instantaneously tripping the circuit breaker.

Furthermore, the temperature-compensating bimetal 14 in the illustrated example is bent like a hairpin and has one pivotally supported end. However, the temperature-compensating bimetal may be linearly formed so as to have a longitudinally intermediate point thereof journaled by the bearing so as to swing therearound, with one end thereof facing the output lever of the differential shifter mechanism and the other end facing the latch receiver of the opening-and-closing mechanism section via the intermediate lever. Alternatively, the tip of the temperature-compensating bimetal may extend toward the latch receiver without using the intermediate lever, or another metallic arm portion may be welded to the tip of the temperature-compensating bimetal so as to directly push the latch receiver, thereby allowing signals to be transmitted more efficiently.

In the above conventional configuration for the temperature-compensating bimetal, also acting as the tripping lever, opposite sides extending from the swinging shaft support point thereof toward the differential shifter and the latch receiver, respectively, have different lengths and masses.

In this case, if the temperature-compensating bimetal is linearly formed so as to have the longitudinally intermediate point journaled by the bearing to swing therearound, and the tip of the temperature-compensating bimetal is extended toward the latch receiver or another metallic arm portion is welded to the tip of the temperature-compensating bimetal so as to face the latch receiver, then the tip side with respect to the swinging shaft support point has a larger mass and thus a larger inertial moment than the opposite end. Consequently, the opposite sides of the temperature-compensating bimetal with respect to the swinging shaft support point are imbalanced.

Therefore, if an external stimulus, e.g., vibration or impact, is applied to a circuit breaker during use, the temperature-compensating bimetal may swing around the swinging shaft support point like a pendulum due to the difference in the inertial moment described above, pushing the latch receiver of the opening-and-closing mechanism section to its released position. Thus, although no overload current is flowing through the main circuit, the circuit breaker may be tripped to interrupt the main circuit.

The present invention is designed to resolve these issues, and an object of the invention is to provide an overload tripping device for a circuit breaker having an improved vibration-resisting performance so as to prevent the circuit breaker from being inadvertently tripped due to an external stimulus, such as a vibration or impact.

SUMMARY OF THE INVENTION

To attain this objective, the present invention provides an overload tripping device for a circuit breaker formed of a combination of a main bimetal for detecting overloads, a differential shifter mechanism linked with the main bimetal, and a temperature-compensating bimetal interposed between an output end of the differential shifter mechanism and an opening-and-closing mechanism section to transmit an output signal from the differential shifter to a latch receiver of the opening-and-closing mechanism section. The temperature-compensating bimetal also acts as a tripping lever, and has an longitudinally intermediate portion journaled so as to swing therearound and one end facing an output lever of the differential shifter mechanism. An operating arm made of a molding material, such as plastic, that has a lower density than metal is attached to a tip of the temperature-compensating bimetal, so that the tip of the temperature-compensating bimetal faces the latch receiver of the opening-and-closing mechanism section via the operating arm (first aspect of the invention).

With this configuration, the tip side of the temperature-compensating bimetal is lighter than the conventional structure, which has a portion pushing the latch receiver made of metal, thus reducing the difference in an inertial moment between the opposite sides of the bimetal with respect to the swinging shaft support point to maintain a substantially even balance between these sides. This, in turn, reduces the swinging vibration of the temperature-compensating bimetal induced by an external stimulus, thereby allowing the circuit breaker to resist vibration properly when it is inadvertently tripped.

Furthermore, according to the present invention, in order to further improve the vibration resistance of the overload tripping device, the temperature-compensating bimetal has a balance weight additionally installed thereon to correct imbalance between the inertial moments on opposite sides thereof with respect to the shaft support point thereof (second aspect of the invention).

By adding the balance weight to the temperature-compensating bimetal, the above-described balance of the inertial moment can be further enhanced. The balance weight is made of metal and is attached to an optimal position, depending on the degree of deviation of the center of gravity of the temperature-compensating bimetal that deviates from its correct position.

BRIEF DESCRIPTION OF THE DRAWINGS

FIGS. 1(*a*) to 1(*c*) show a configuration of essential parts of an overload tripping device according to an embodiment of the present invention, wherein FIG. 1(*a*) is a top plan view, FIG. 1(*b*) is a front view, and FIG. 1(*c*) is a side view;

FIGS. 2(*a*) to 2(*d*) illustrate an operation performed by the device shown in FIGS. 1(*a*)–1(*c*), wherein FIGS. 2(*a*) and 2(*b*) are top plan views of the tripping device, illustrating a steady state and a tripping operation state, respectively, and FIGS. 2(*c*) and 2(*d*) are side views of the tripping device, illustrating the steady state and the tripping operation state, respectively.

DETAILED DESCRIPTION OF PREFERRED EMBODIMENTS

Embodiments of the present invention will be described below on the basis of structures shown in FIG. 1(*a*) to FIG. 2(*d*).

Figure 3A:
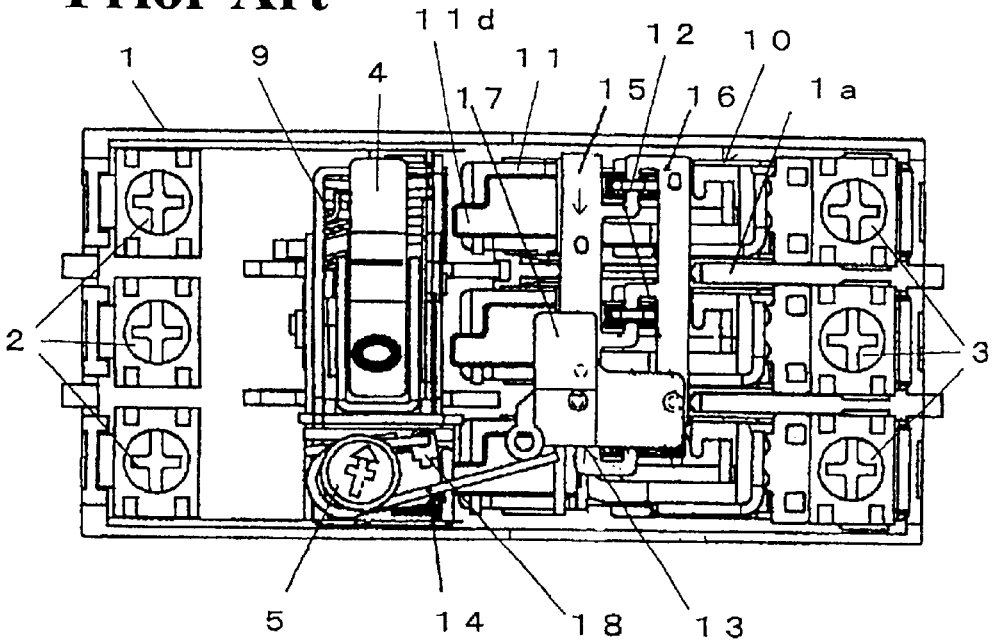
Fig. 3(a) Prior Art
FIGS. 3(*a*) and 3(*b*) show an entire structure of an autobreaker in which a conventional overload tripping device is installed, wherein FIG. 3(*a*) is a top plan view illustrating an internal mechanism, and FIG. 3(*b*) is a side sectional view thereof.
Figure 3B:
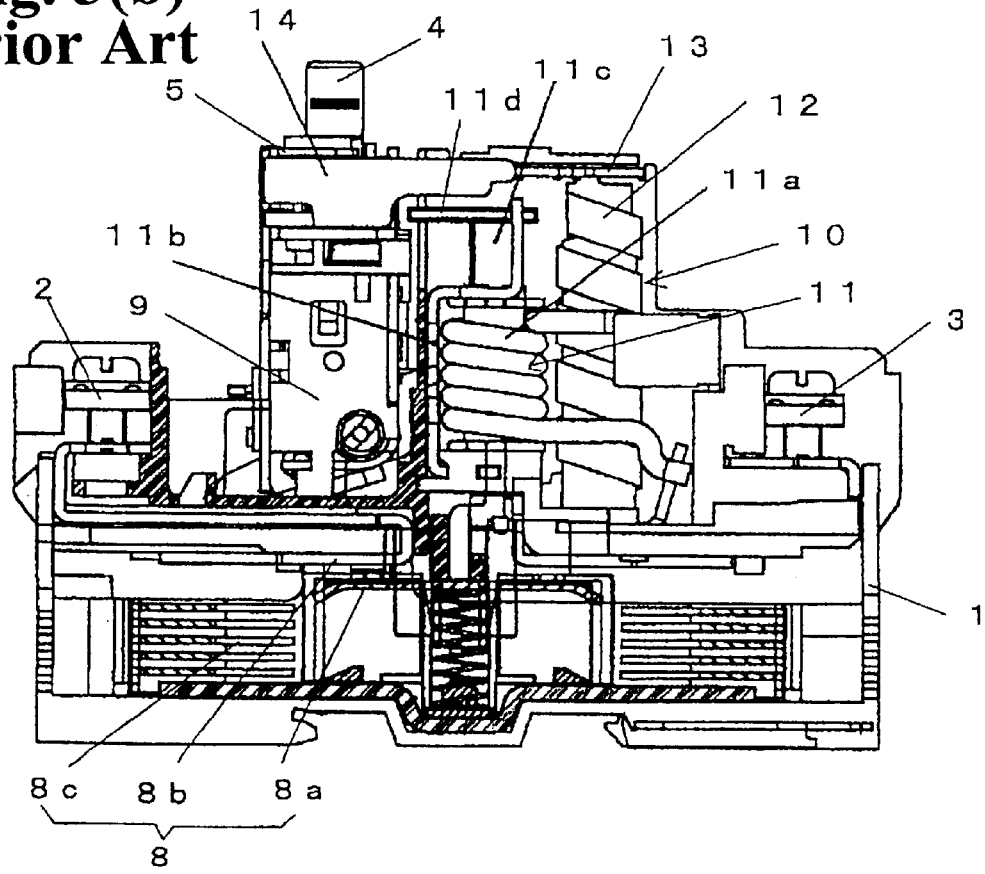
Fig. 3(b) Prior Art

In the figures illustrating the embodiment, members that correspond to FIGS. 3(*a*) and 3(*b*) are denoted by the same reference numerals, and a description thereof is omitted.

First, in FIGS. 1(*a*) to 1(*c*), a temperature-compensating bimetal 14, also acting as an overload tripping lever of the circuit breaker, is formed by a plate-like piece of bimetal, and has a longitudinally intermediate portion journaled on a bimetal holder 5*b* assembled on a holder 5*a* for the adjustment dial 5, so that the bimetal can swing in the direction indicated by the arrows in the figures. The temperature-compensating bimetal 14 has a right end facing the output lever 17 of the differential shifter mechanism 13, as described in FIGS. 3(*a*) and 3(*b*). Furthermore, a left end of the temperature-compensating bimetal 14 has an operating arm 19 having a holding portion or hole 19*a* and a tip 19*b*. The operating arm is made of plastic, e.g. nylon, which is lighter than metal. The temperature-compensating bimetal 14 is fitted in the holding portion 19*a*, and the tip 19*b* of the operating arm 19 faces the latch receiver 9*a* of the opening-and-closing mechanism section to be able to push the same. The bimetal holder 5*b* is linked with a cam portion (not shown) of the adjustment dial 5 to move and regulate the position of a shaft support point A of the temperature-compensating bimetal 14 in accordance with a set value for the rated current.

A tripping operation of the above configuration will be described with reference to FIGS. 2(*a*) to 2(*d*). FIGS. 2(*a*) and 2(*c*) illustrate a steady state, and FIGS. 2(*b*) and 2(*d*) illustrate an overload tripping state. That is, in the steady state, the output lever 17 is stopped in a receding position where it is separated from the temperature-compensating bimetal 14. Accordingly, the temperature-compensating bimetal 14 is in a free neutral state in which the operating arm 19 installed at the tip of the bimetal does not push the latch receiver 9*a*, so that the breaking section 8 of the circuit breaker, shown in FIG. 3(*b*), remains in a closed condition.

On the other hand, when the main bimetal described in FIGS. 3(*a*) and 3(*b*) detects an overload or an open phase in the main circuit, the differential shifter mechanism follows the bending of the main bimetal to cause the output lever 17 to push the temperature-compensating bimetal 14. Therefore, the temperature-compensating bimetal 14 swings clockwise around the swinging shaft support point A, and a tip 19*a* of the operating arm 19 thus pushes the latch receiver 9*a* in the direction shown by the arrows in the figures. As a result, the latch receiver 9*a* moves to its released position using a support shaft 9*a*-1 as a support point, thereby tripping the opening-and-closing mechanism section. Simultaneously with this tripping operation, the breaking section is opened.

In this case, since the operating arm 19 installed at the tip of the temperature-compensating bimetal 14 is made of plastic molding, which has a lower density than metal, as described above, the balance between inertial moments on the right and left sides of the temperature-compensating bimetal 14, including the operating arm 19, with respect to the swinging shaft support point A is substantially maintained in order to restrain the center of gravity from deviating from its correct position.

Consequently, even if an external stimulus, such as a vibration or impact, is applied to the circuit breaker, the temperature-compensating bimetal 14 will not be stimulated and swing like a pendulum around the shaft support point A to push the latch receiver 9*a* of the opening-and-closing mechanism section to its released position, thereby inadvertently tripping the circuit breaker. Thus, the tripping device can resist vibration more appropriately.

Next, an applied variation of the embodiment according to a second aspect of the invention is explained, in which the above tripping device has a further improved vibration resistance. That is, in the above configuration, if the mass is still imbalanced between the right and left sides of the temperature-compensating bimetal 14 with respect to the swinging shaft support point A when the operating arm 19 attached to the tip of the temperature-compensating bimetal 14 is made of plastic molding which is lighter than metal, a balance weight 20 is additionally attached to a location of the temperature-compensating bimetal 14 at the right side with respect to the shaft support point A, as shown in the illustrated embodiment. Thus, the inertial moment with respect to the shaft support point A can be corrected in order to maintain an even balance between the right and left sides of the bimetal. The balance weight 20 is made of metal and is attached to an optimal location so that the balance of the temperature-compensating bimetal 14 is maintained.

As described above, according to the configuration of the present invention for the temperature-compensating bimetal interposed between the output end of the differential shifter mechanism and the opening-and-closing mechanism section to transmit an output signal from the differential shifter to the latch receiver of the opening-and-closing mechanism section, with the temperature-compensating bimetal also acting as a tripping lever, the operating arm made of a light molding material is attached to the tip of the temperature-compensating bimetal so that the tip of the temperature-compensating bimetal faces the latch receiver of the opening-and-closing mechanism section via the operating arm. Consequently, the difference in inertial moment between the opposite sides of the temperature-compensating bimetal with respect to the swinging shaft support point is reduced in order to maintain a substantially even balance between these sides. This reduces the pendulum vibration of the temperature-compensating bimetal induced by an external stimulus, thereby allowing the circuit breaker to resist vibration more properly when it is inadvertently tripped.

By adding the balance weight to the temperature-compensating bimetal to correct the imbalance between the inertial moments on the opposite sides of the bimetal with respect to the shaft support point thereof, the balance of the inertial moment can be further enhanced to improve the vibration resistance.

While the invention has been explained with reference to the specific embodiments of the invention, the explanation is illustrative and the invention is limited only by the appended claims.

What is claimed is:

1. An overload tripping device for a circuit breaker, comprising:

a main bimetal for detecting an overload, a differential shifter mechanism linked with the main bimetal and having an output end, and a temperature-compensating bimetal device situated adjacent to the output end of the differential shifter mechanism to transmit an output signal from the differential shifter to a latch receiver of an opening-and-closing mechanism section and acting as a tripping lever, said temperature-compensating bimetal device having an intermediate portion in a longitudinal direction thereof to be journaled to swing thereat, one end facing the output end of the differential shifter, and an operating arm made of a light molding material attached to the other end thereof and adapted to face the latch receiver of the opening-and-closing mechanism.

2. An overload tripping device according to claim 1, wherein said temperature-compensating bimetal device has a balance weight thereon to correct any imbalance between inertial moments on opposite sides thereof with respect to the intermediate portion thereof.

3. An overload tripping device according to claim 1, wherein said temperature-compensating bimetal device has an elongated bimetal having said one and the other ends, and said operating arm has a holding portion for receiving the other end of the bimetal and a tip extending from the holding section to face the latch receiver.

4. An overload tripping device according to claim 3, wherein said elongated bimetal has projections extending opposite directions at the intermediate portion.

* * * * *

UNITED STATES PATENT AND TRADEMARK OFFICE

CERTIFICATE OF CORRECTION

PATENT NO. : 6,621,403 B2 
DATED : September 16, 2003
INVENTOR(S) : Isamu Nagahiro et al.

It is certified that error appears in the above-identified patent and that said Letters Patent is hereby corrected as shown below:

Column 2,
Line 2, change “temperature5 com-” to -- temperature-com --; and

Column 4,
Line 17, do not make new paragraph and continue to “2(d).” on line 16.

Signed and Sealed this

Fourth Day of November, 2003

JAMES E. ROGAN
*Director of the United States Patent and Trademark Office*